US009815283B2

(12) United States Patent
Hayashi et al.

(10) Patent No.: US 9,815,283 B2
(45) Date of Patent: Nov. 14, 2017

(54) LIQUID DISCHARGING APPARATUS

(71) Applicant: Brother Kogyo Kabushiki Kaisha, Nagoya-shi, Aichi-ken (JP)

(72) Inventors: Hideki Hayashi, Nagoya (JP); Keita Hirai, Nagoya (JP); Atsushi Hirota, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/092,669

(22) Filed: Apr. 7, 2016

(65) Prior Publication Data

US 2016/0347063 A1 Dec. 1, 2016

(30) Foreign Application Priority Data

May 25, 2015 (JP) ..... 2015-105351

(51) Int. Cl.
*B41J 2/14* (2006.01)

(52) U.S. Cl.
CPC .. *B41J 2/14233* (2013.01); *B41J 2002/14459* (2013.01); *B41J 2002/14491* (2013.01)

(58) Field of Classification Search
CPC ..... B41J 2/14209; B41J 2/14233; B41J 2/04515; B41J 2002/14459; B41J 2002/14491
See application file for complete search history.

(56) References Cited

U.S. PATENT DOCUMENTS

2003/0117464 A1* 6/2003 Miyata ..... B41J 2/161 347/71
2014/0253641 A1* 9/2014 Furuya ..... B41J 2/14201 347/71
2016/0243830 A1* 8/2016 Naito ..... B41J 2/14233

FOREIGN PATENT DOCUMENTS

JP 2003-127365 A 5/2003

* cited by examiner

*Primary Examiner* — Sharon A Polk
(74) *Attorney, Agent, or Firm* — Banner & Witcoff, Ltd.

(57) ABSTRACT

A liquid discharging apparatus includes: a channel structure having nozzles aligned in a first direction and pressure chambers aligned in the first direction corresponding to the nozzles respectively; piezoelectric elements aligned in the first direction in the channel structure, corresponding to the pressure chambers respectively; a cover covering the piezoelectric elements and having first and second wall portions arranged in a second direction orthogonal to the first direction and joined to the channel structure at first and second joint regions respectively; and traces being extended to one side in the second direction from the piezoelectric elements respectively, passing through the first region, and extending up to outside of the cover. An area of the first joint region is greater than an area of the second region.

20 Claims, 8 Drawing Sheets

LIQUID DISCHARGING APPARATUS

CROSS REFERENCE TO RELATED APPLICATION

The present application claims priority from Japanese Patent Application No. 2015-105351 filed on May 25, 2015 the disclosure of which is incorporated herein by reference in its entirety.

BACKGROUND

Field of the Invention

The present invention relates to a liquid discharging apparatus.

Description of the Related Art

Japanese Patent Application Laid-open No. 2003-127365 discloses an ink-jet head, as a liquid discharging apparatus, which discharges an ink onto a recording medium to thereby record an image, etc. on the recording medium. The ink-jet head described in Japanese Patent Application Laid-open No. 2003-127365 is provided with a nozzle plate, a channel forming substrate, a plurality of piezoelectric elements, and a reservoir forming substrate. The nozzle plate is formed with a plurality of nozzles. The channel forming substrate is formed with a plurality of pressure chambers communicating with the plurality of nozzles, respectively. The plurality of piezoelectric elements is provided on the channel forming substrate such that the piezoelectric elements correspond to the plurality of pressure chambers, respectively. The reservoir forming substrate is joined to the channel forming substrate so as to cover the plurality of piezoelectric elements. The plurality of nozzles is aligned to form two nozzle rows. The plurality of pressure chambers are also aligned to form two pressure chamber rows corresponding to the arrangement of the nozzles. The plurality of piezoelectric elements are also aligned to form two piezoelectric element rows corresponding to the arrangement of the nozzles.

A plurality of traces are connected to individual electrodes of the piezoelectric elements, respectively. The traces are extending from the piezoelectric elements corresponding thereto, respectively, in a direction orthogonal to an alignment direction in which the piezoelectric elements are aligned. The traces are extended to an outer area (outer region) located at the outside of the reservoir forming substrate. Further, the traces are electrically connected to a driver (driving circuit) arranged on the reservoir forming substrate, via wire bonding. The driver outputs a drive signal to each of the piezoelectric elements via one of the traces.

The reservoir forming substrate has three wall portions. The three wall portions include two outer wall portions and an inner wall portion. The two outer wall portions are located at the outer sides, respectively, of the two piezoelectric element rows in the direction orthogonal to the arrangement direction. The inner wall portion is located between the two piezoelectric element rows. These three wall portions are each joined to the channel forming substrate. Each of the two outer wall portions is joined to the traces extending from the individual electrodes of the respective piezoelectric elements. Further, each of the two outer wall portions of the reservoir forming substrate has a width narrower than a width of the inner wall portion.

SUMMARY

By the way, when the driver outputs a drive signal to each of the piezoelectric elements, heat is generated in the driver.

Since a portion of the heat is transferred (conducted) to the channel forming substrate via the traces, the temperature of the piezoelectric elements and the temperature of a liquid in the pressure chambers are raised. In this situation, if the difference in heat transfer amount is great among the pressure chambers, or among the piezoelectric elements, this might be a factor causing a large difference in the discharge characteristic among the nozzles. Therefore, for the purpose of suppressing any unevenness in the discharge characteristic, it is effective to radiate the heat, which is transferred from the driver via the traces, as much as possible before the heat is transferred to the piezoelectric elements and/or to the liquid inside the pressure chambers.

In the ink-jet head described in Japanese Patent Application Laid-open No. 2003-127365, the traces are extended respectively from the piezoelectric elements aligned in the two rows such that each of the traces is extended up to a region outside of the reservoir forming substrate. Namely, each of the traces is arranged in a joint region at which one of the two outer wall portions of the reservoir forming substrate is joined to the channel forming substrate. It can be considered that, owing to this configuration, a portion of the heat transferred from the driver to the traces is radiated from the outer wall portions of the reservoir forming substrate. However, in the ink-jet head described in Japanese Patent Application Laid-open No. 2003-127365, the width of the outer wall portions of the reservoir forming substrate (joining area or joining dimension to the channel forming substrate) is small. Thus, any great heat radiating effect via the reservoir forming substrate cannot be much expected.

In view of the above-described situation, an object of the present teaching is to provide a liquid discharging apparatus capable of promoting the radiation of heat transferred from the driver to the traces, and capable of suppressing the heat transfer to the liquid inside the pressure chambers and to the piezoelectric elements.

According to a first aspect of the present teaching, there is provided a liquid discharging apparatus including:

a channel structure having nozzles aligned in a first direction and pressure chambers aligned in the first direction corresponding to the nozzles respectively;

piezoelectric elements aligned in the first direction in the channel structure, corresponding to the pressure chambers respectively;

a cover covering the piezoelectric elements and having a first wall portion and a second wall portion which are arranged in a second direction orthogonal to the first direction, the first wall portion being arranged on one side in the second direction relative to the piezoelectric elements and joined to the channel structure at a first joint region, the second wall portion being joined to the channel structure at a second joint region; and traces configured to be electrically connected to a driver for driving the piezoelectric elements, the traces being extended to the one side in the second direction from the piezoelectric elements respectively, passing through the first joint region, and extending up to outside of the cover, wherein an area of the first joint region is greater than an area of the second joint region.

According to a second aspect of the present teaching, there is provided a liquid discharging apparatus including:

a channel structure having a pressure chamber;

a piezoelectric element disposed over the pressure chamber;

a cover covering the piezoelectric element, and joined to the channel structure at a first joint region and a second joint region with the piezoelectric element being located between the first joint region and the second joint region; and a trace extending from the piezoelectric element, passing through the first joint region, and extending up to outside of the cover, wherein an area of the first joint region is greater than an area of the second joint region.

According to a second aspect of the present teaching, there is provided a liquid discharging apparatus including:

a cover; and an assembly joined to the cover at a first joint region and a second joint region and including a piezoelectric element and a trace, the piezoelectric element being configured to deform a pressure chamber and to be covered by the cover, the trace extending from the piezoelectric element and passing through the first joint region, wherein the piezoelectric element is disposed between the first joint region and the second joint region, and an area of the first joint region is greater than an area of the second joint region.

DESCRIPTION OF THE EMBODIMENTS

Figure 1:
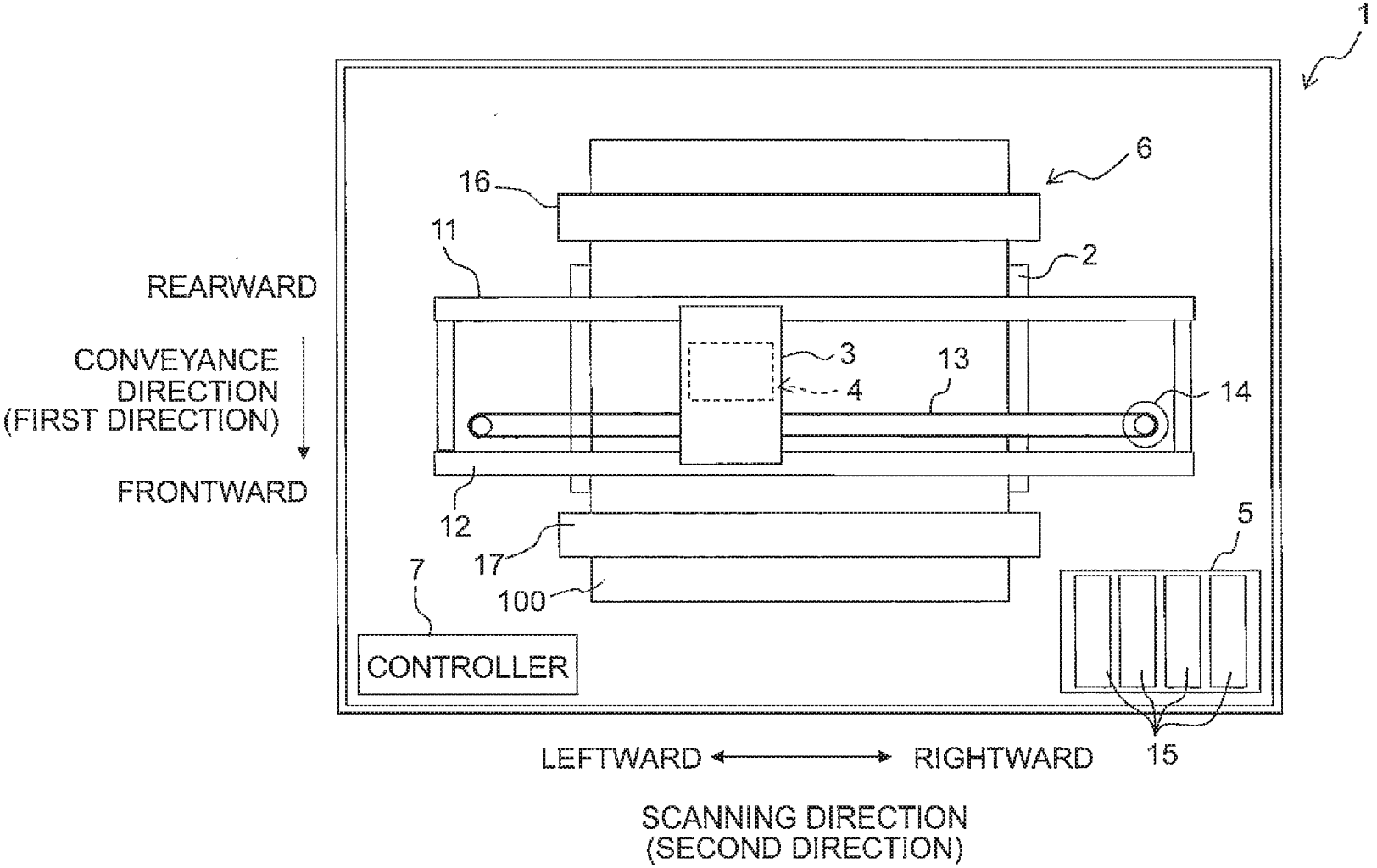
FIG. 1 is a schematic plan view of a printer according to an embodiment of the present teaching.

Next, an embodiment of the present teaching will be described, with reference to the drawings as appropriate. Note that the respective directions of front, rear, left, right as depicted in FIG. 1 are defined as "front (frontward)", "rear (rearward)", "left (leftward)" and "right (rightward)" of the printer. Further, the fore side (front side) of the sheet surface of FIG. 1 is defined as "up (upward), and the far side (the other side) of the sheet surface of FIG. 1 is defined as "down (downward)". In the following, the respective directional terms of front, rear, left, right, up and down are appropriately used.

<Schematic Configuration of Printer>

As depicted in FIG. 1, an ink-jet printer 1 is provided with a platen 2, a carriage 3, an ink-jet head 4, a cartridge holder 5, a conveyance mechanism 6, a controller 7, etc.

On the upper surface of the platen 2, a recording paper (recording paper sheet) 100 as a recording medium is placed. The recording paper 100 faces or is arranged opposite to the ink-jet head 4 (to be described later on) with a spacing distance suitable for image formation. The carriage 3 is supported by two guide rails 10, 11 and is thereby configured to reciprocate in the left and right directions (hereinafter referred to also as a "scanning direction"). An endless belt 13 is connected to the carriage 3. When the endless belt 13 is driven by a carriage drive motor 14, the carriage 3 is thereby moved in the scanning direction together with the endless belt 13.

The ink-jet head 4 (an example of a "liquid discharging apparatus" of the present teaching) is attached to the carriage 3. The ink-jet head 4 has a plurality of nozzles 24 (see FIGS. 2 to 4) formed in the lower surface thereof (a surface on the far side in the sheet surface of FIG. 1).

On the cartridge holder 5, ink cartridges 15 for inks of four colors (black, yellow, cyan and magenta) are detachably installed. The ink cartridges 15 are connected, by non-illustrated tubes, to the ink-jet head 4. The four color inks stored in the four ink cartridges 15, respectively, are supplied to the ink-jet head 4 via the tubes. The ink-jet head 4 causes the ink(s) to be discharged from the nozzles 24, formed in the lower surface of the ink-jet head 4, toward the recording paper 100 placed on the platen 2, while the ink-jet head 4 is moving in the scanning direction together with the carriage 3. The detailed configuration of the ink-jet head 4 will be described later on.

The conveyance mechanism 6 has two conveyance rollers 16, 17 arranged to sandwich the platen 2 therebetween in the front and rear directions. The two conveyance rollers 16 and 17 are driven while being synchronized to each other by a conveyance motor (not depicted in the drawings). The conveyance mechanism 6 conveys the recording paper 100 placed on the platen 2 in the front direction (hereinafter referred to also as a "conveyance direction") by the two conveyance rollers 16 and 17.

The controller 7 includes a Central Processing Unit (CPU), a Read Only Memory (ROM), a Random Access Memory (RAM), an Application Specific Integrated Circuit (ASIC) including various control circuits, etc. The controller 7 causes the ACIS to perform various processes such as printing onto the recording paper 100, etc., by executing programs stored in the ROM at the CPU. For example, in the printing process, based on a print command inputted from an external device such as a Personal Computer (PC), the controller 7 controls the ink-jet head 4, the carriage drive motor 14, the conveyance motor of the conveyance mechanism 6 etc., so as to print an image, etc. on the recording paper 100. More specifically, the controller 7 alternately performs an ink discharging operation for causing the ink to be discharged while moving the ink-jet head 4 in the scanning direction together with the carriage 3, and a conveyance operation for causing the conveyance rollers 16 and 17 to convey the recording paper 100 by a predetermined amount in the conveyance direction.

<Detailed Configuration of Ink-Jet Head>

Figure 2:
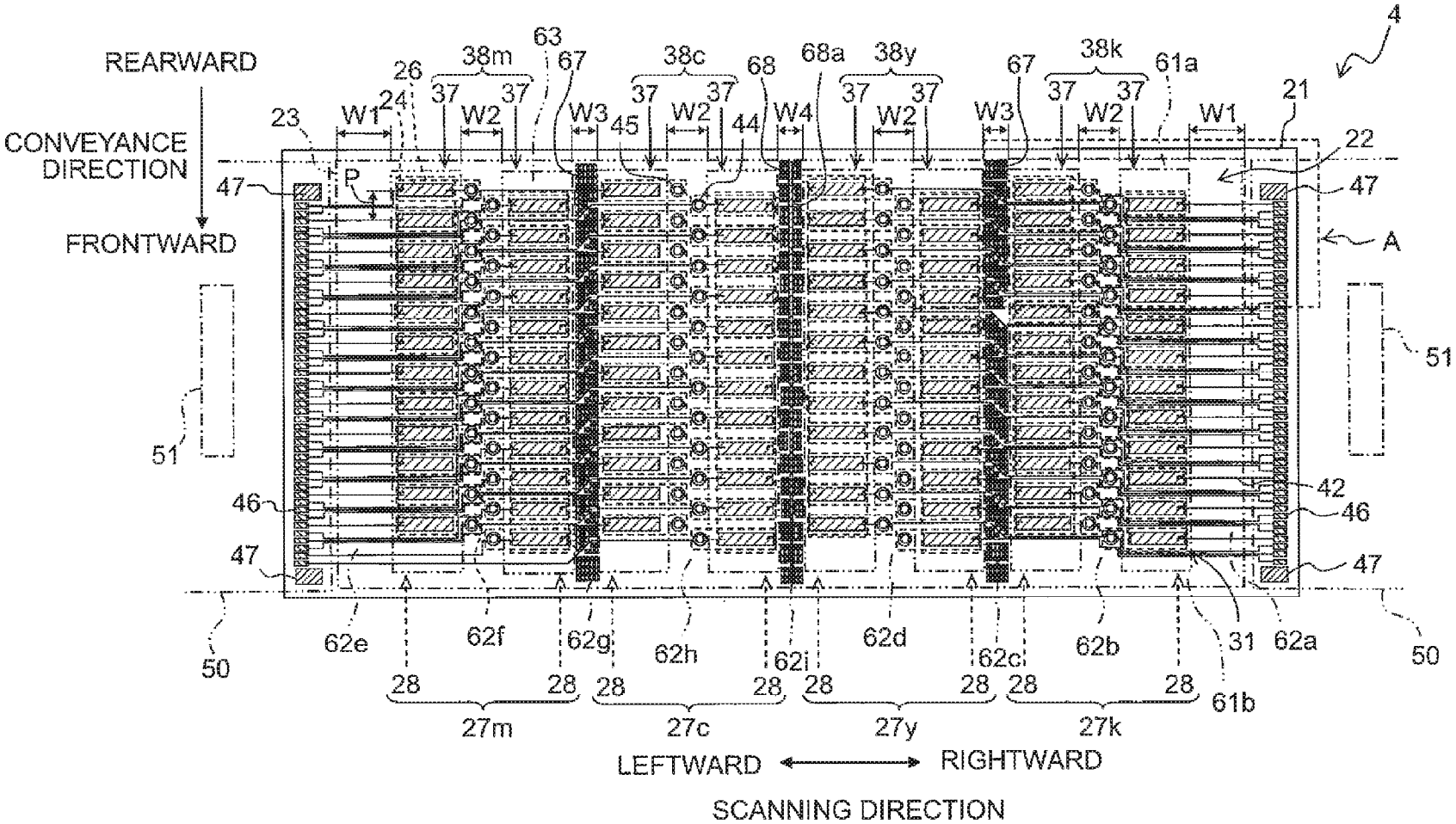
FIG. 2 is a plan view of an ink-jet head.
Figure 3:
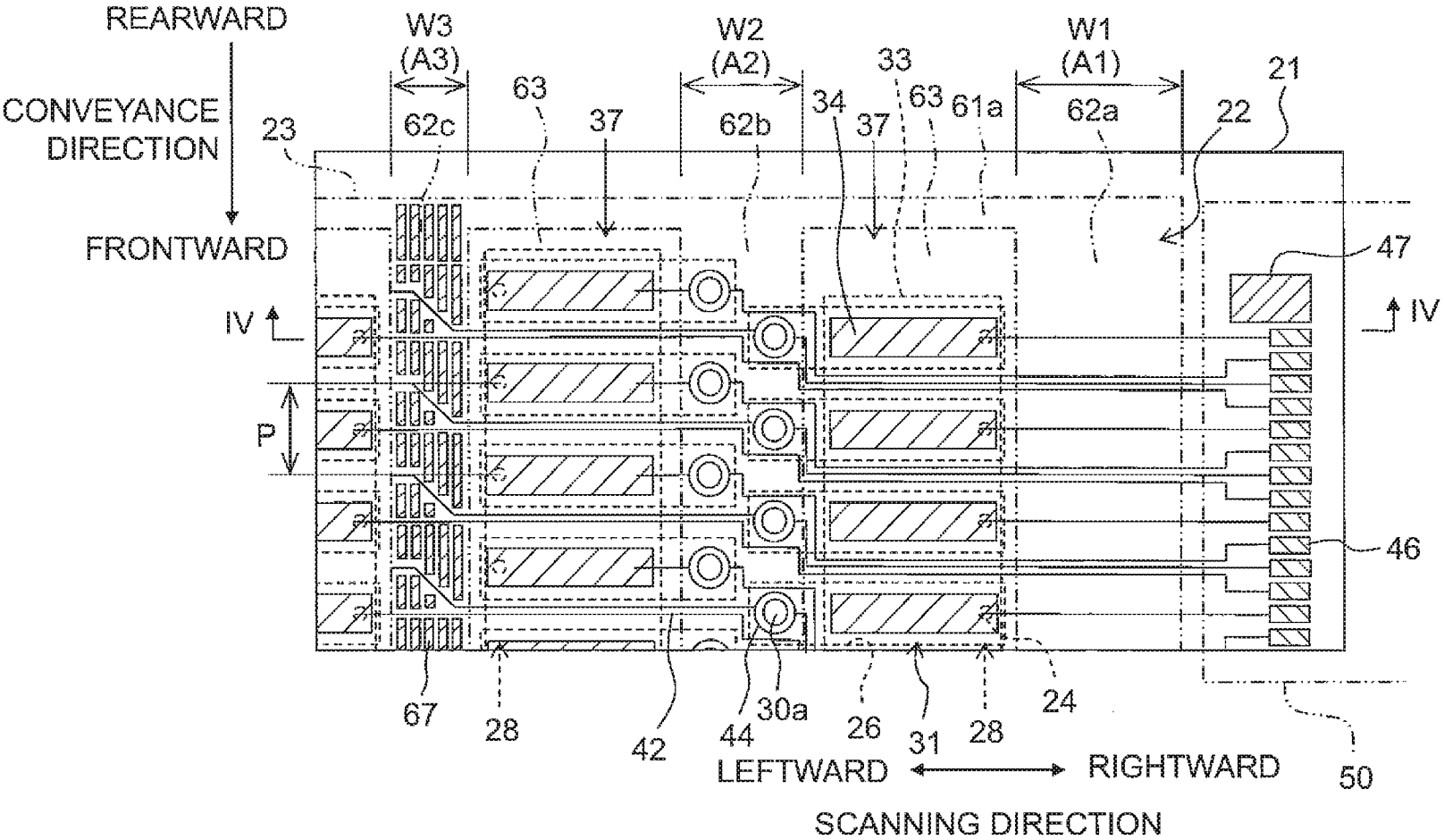
FIG. 3 is an enlarged view of an A-portion in FIG. 2.
Figure 4:
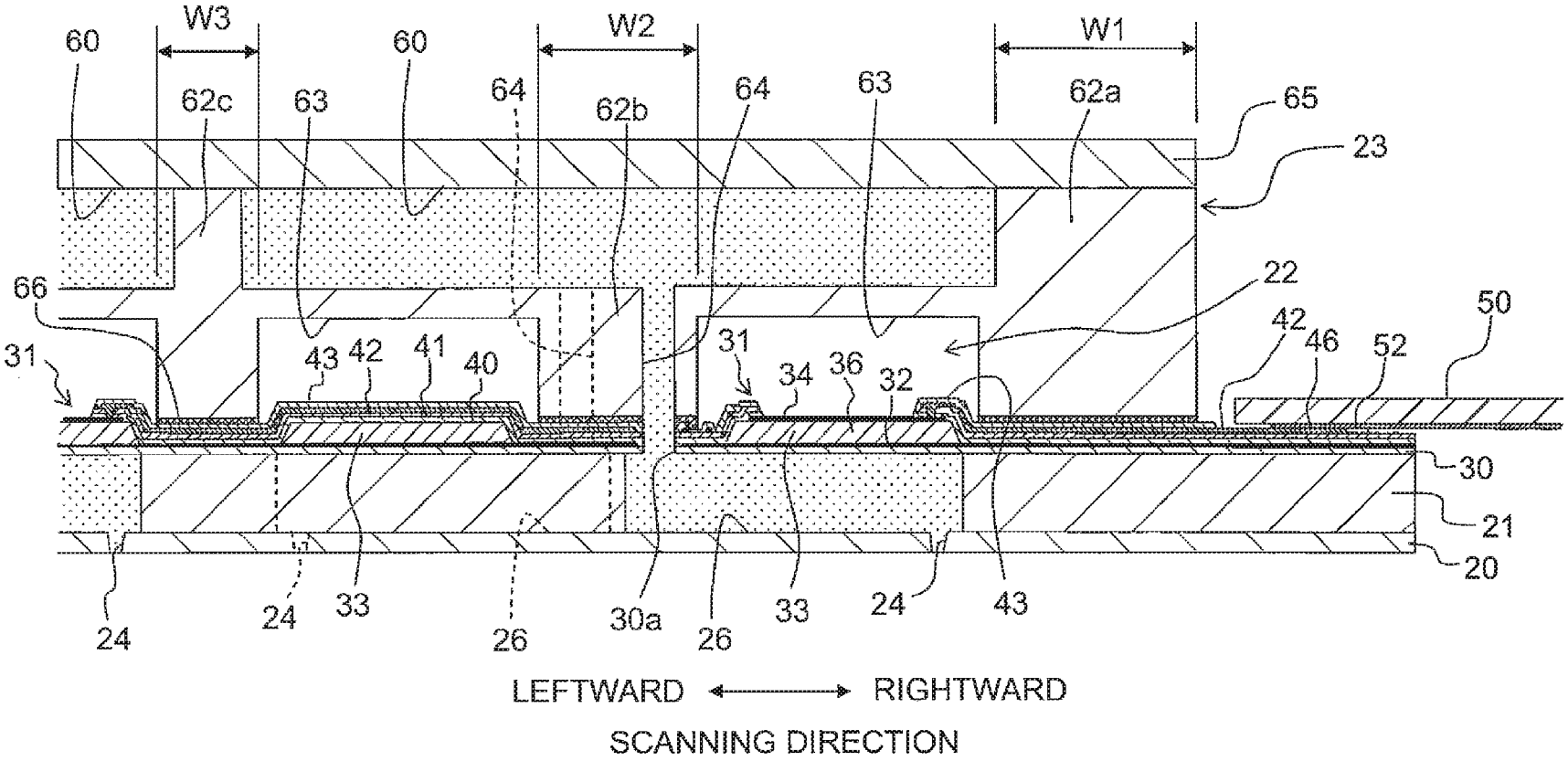
FIG. 4 is a cross-sectional view taken along a line IV-IV in FIG. 3.

Next, the configuration of the ink-jet head 4 will be explained in detail. As depicted in FIGS. 2 to 4, the ink-jet head 4 includes a nozzle plate 20, a channel substrate 21, a piezoelectric actuator 22, a cover 23, etc. Note that in FIGS. 2 and 3, a COF (Chip On Film) 51 and the cover 23 which are joined to the upper surface of the channel substrate 21 are schematically depicted by a two-dot chain lines, for the purpose of simplifying the drawings.

<Nozzle Plate>

The nozzle plate 20 is a plate formed of, for example, silicon, etc. The plurality of nozzles 24 aligned in the conveyance direction (an example of a "first direction" in the present teaching) are formed in the nozzle plate 20.

More specifically, as depicted in FIG. 2, the nozzle plate 20 is formed with four nozzle groups 27 which are arranged side by side to one another in the scanning direction (an example of a "second direction" in the present teaching). Mutually different inks are discharged from the four nozzle groups 27, respectively. Note that in the following explanation, among components or parts constructing the ink-jet head 4, those corresponding to inks of colors black "K", yellow "Y", cyan "C" and magenta "M", respectively are each added, at the end of the reference numeral thereof, with a suffix indicating the colors such as "k" (indicating black), "y" (indicating yellow), "c" (indicating cyan) and "m" (indicating magenta) as appropriate, so as to indicate to which color inks these components or parts correspond respectively. For example, a nozzle group 27*k* indicates a nozzle group 27, among the nozzle groups 27, discharging the black ink. Each of the nozzle groups 27 is composed of two nozzle rows 28 arranged on the left and right sides. In each of the nozzle rows 28, the plurality of nozzles 24 are aligned at a nozzle arrangement pitch "P". Further, between two nozzle rows 28, positions of the nozzles 24 in one of the two nozzle rows 28 and positions of the nozzles 24 in the other one of the two nozzle rows 28 are deviated or shifted from each other, in the conveyance direction, by a half (P/2) of the nozzle arrangement pitch P in each nozzle row. Namely, the plurality of nozzles 24 constructing one nozzle group 27 are aligned in two rows in a staggered manner.

<Channel Substrate>

The channel substrate 21 is a substrate formed of a silicon single crystal. The channel substrate 21 is formed with a plurality of pressure chambers 26 communicating with the plurality of nozzles 24, respectively; each of the pressure chambers 24 penetrates through the channel substrate 21. Each of the pressure chambers 26 has a rectangular shape in a plan view which is elongated in the scanning direction. The plurality of pressure chambers 26 are aligned in the conveyance direction in accordance with the alignment of the plurality of nozzles 24 as described above, and construct two pressure chamber rows per one color of the inks, namely construct a total of 8 pieces of pressure chamber rows. The lower surface of the channel substrate 21 is covered by the nozzle plate 20, wherein an outer end portion of each of the pressure chambers 26 is overlapped with one of the nozzles 24. Specifically, as depicted in FIG. 3, in a pressure chamber row arranged on the right side, a right end portion of each of the pressure chambers 26 is overlapped with one of the nozzles 24; and in a pressure chamber row arranged on the left side, a left end portion of each of the pressure chambers 26 is overlapped with one of the nozzles 24. Note that the nozzle plate 20 and the channel substrate 21 as described above correspond to a "channel structure" of the present teaching.

The upper surface of the channel substrate 21 is covered by a vibration film 30. The vibration film 30 is a film formed by oxidizing or nitriding a surface of the silicon substrate. The vibration film 30 may be a stacked film of silicon oxide or silicon nitride formed by means of the sputtering method, CVD method, etc. A portion, of the vibration film 30, covering an inner side end portion of each of the pressure chambers 26 (an end portion of each of the pressure chambers 26 located on the opposite side to another end portion thereof facing the nozzle 24) is formed with an ink supply hole 30*a*.

The ink is supplied from a reservoir 60 (to be described later on) inside the cover 23 to each of the pressure chambers 26 via the ink supply hole 30*a*. Further, when a discharge energy is imparted to the ink inside a certain pressure chamber 26 by a piezoelectric actuator 22 (to be described later on), an ink droplet of the ink is discharged from a nozzle 24 communicating with the certain pressure chamber 26.

<Piezoelectric Actuator>

The piezoelectric actuator 22 includes the vibration film 30 and a plurality of piezoelectric elements 31, and is configured to impart the discharge energy for causing the ink inside each of the pressure chambers 26 to be discharged from one of the nozzles 24. As depicted in FIGS. 2 to 4, the plurality of piezoelectric elements 31 are arranged on the upper surface of the vibration film 30, corresponding to the plurality of pressure chambers 26, respectively.

The configuration of each of the piezoelectric elements 31 will be explained. Each of the piezoelectric elements 31 includes a common electrode 32, a piezoelectric body 33 and an individual electrode 34 which are stacked in this order on the vibration film 30. As depicted in FIG. 4, the common electrode 32 is formed substantially on the entire surface of the vibration film 30 so as to include regions, of the vibration film 30, which face the plurality of pressure chambers 26. Eight pieces of band-shaped piezoelectric body 33 are formed on the common electrode 32, corresponding to the eight pressure chamber rows, respectively. As depicted in FIG. 3, each piezoelectric body 33 has a rectangular shape in a plan view which is elongated in the conveyance direction, and with respect to the conveyance direction, each piezoelectric body 33 is arranged to straddle pressure chambers 26 which form a pressure chamber row corresponding thereto. Each piezoelectric body 33 is made, for example, of a piezoelectric material of which main component is lead zirconate titanate (PZT) that is a mixed crystal of lead titanate and lead zirconate. Alternatively, each piezoelectric body 33 may be made of a lead-free piezoelectric material that does not contain any lead.

A plurality of pieces of the individual electrode 34 are formed respectively on the upper surfaces of the piezoelectric bodies 33 such that the individual electrodes 34 individually face the pressure chambers 26, respectively. Each of the individual electrodes 34 has a rectangular shape in a plan view which is smaller to some extent than one of the pressure chambers 26; each of the individual electrodes 34 is arranged so as to overlap with a central portion of one of the pressure chambers 26 corresponding thereto. The individual electrode 34 is formed, for example, of iridium (Ir).

In the configuration as described above, with respect to one of the pressure chambers 26, a piezoelectric element 31 is composed of respective components that are the common electrode 32, the piezoelectric body 33 and the individual electrode 34 which face the pressure chamber 26. In other words, the common electrode 32 and the piezoelectric body 33 are shared by a plurality of piezoelectric elements 31. Note that a portion, of the piezoelectric body 33, which is sandwiched between the common electrode 32 and each of the individual electrodes 34 is hereinafter referred to as an "active portion 36".

Further, the plurality of piezoelectric elements 31 are aligned in the conveyance direction in accordance with the alignment of the plurality of pressure chambers 26. With this, the plurality of piezoelectric elements 31 construct two piezoelectric element rows 37 per one of the colors of the inks, namely construct a total of 8 pieces of piezoelectric element rows 37, in accordance with the alignments of the pressure chambers 26 and of the nozzles 24. Note that among the eight piezoelectric element rows 37, a group of piezoelectric elements 31 composed of two piezoelectric element rows 37 corresponding to one color ink is referred to as a piezoelectric element group 38. As depicted in FIG. 2, four piezoelectric element groups 38 (38*k*, 38*y*, 38*c* and 38*m*) corresponding to the four color inks, respectively, are arranged side by side to one another in the scanning direction.

In this configuration, when an electric field acts between the common electrode 32 and the individual electrode 34 in each of the piezoelectric elements 31, the active portion 36 is deformed in a planar direction of the piezoelectric element 31. In combination with the vibration film 30, the piezoelectric element 31 undergoes a unimorph deformation toward a direction orthogonal to the planar direction. In this situation, the volume of a pressure chamber 26 corresponding to the piezoelectric element 31 is changed. As described above, with respect to each of the pressure chambers 26, an individual actuator is composed of a portion of the vibration film 30 facing the pressure chamber 26 and one of the piezoelectric elements 31 facing the pressure chamber 26. The piezoelectric actuator 22 can be considered as including individual actuators of which number corresponds to the number of the pressure chambers 26.

Further, as depicted in FIG. 4, the piezoelectric actuator 22 has a protective film 40, an insulating film 41, traces 42 and a trace protecting film 43. Note that in FIGS. 2 and 3, the illustration of the protective film 40, the insulating film 41 and the trace protecting film 43 are omitted so that the drawings can be understood more easily.

As depicted in FIG. 4, the protective film 40 is arranged so as to cover the eight piezoelectric bodies 33. The protective film 40 prevents moisture in the air from reaching the piezoelectric bodies 33. The protective film 40 is preferably formed, for example, of a material having a low water permeability such as oxides including alumina ($Al_2O_3$), silicon oxide (SiOx), tantallum oxide (TaOx), etc., or nitrides including silicon nitride (SiN), etc.

The insulating film 41 is formed on the protective film 40. The material forming the insulating film 41 is not particularly limited, and the insulating film 41 is formed, for example, of silicon dioxide ($SiO_2$). The insulating film 41 is provided for the purpose of enhancing the insulating property between the common electrode 32 and the traces 42 connected to the individual electrodes 34, respectively (to be described as follows).

The plurality of traces 42, each extending from the individual electrode 34 of one of the piezoelectric elements 31, are arranged on the insulating film 41 while contacting the insulating film 41. The traces 42 are formed of a material having a low electric resistivity such as aluminum (Al), gold (Au), or the like. Further, the plurality of traces 42 connected to the piezoelectric elements 31 respectively are extending while dividing into the right side and the left side. Specifically, as depicted in FIGS. 2 and 3, the traces 42 are extending rightward from the piezoelectric elements 31 constructing two piezoelectric element groups 38*k* and 38*y* which are included in the four piezoelectric element groups 38 and which are located on the right side; and the traces 42 are extending leftward from the piezoelectric elements 31 constructing two piezoelectric element groups 38*c* and 38*m* which are included in the four piezoelectric element groups 38 and which are located on the left side.

Each of the traces 42 passes through a joint region at which the channel substrate 21 is joined to a wall portion 62 of the cover 23 (to be described later on), and is extended up to a left end portion or a right end portion of the channel substrate 21. Further, in each of the traces 42, a drive contact portion 46 is provided for an end portion on a side to which each of the traces 42 is extended. A grand contact portion 47 is also arranged on each of the left end portion and the right end portion of the channel substrate 21. At each of the left and right end portions of the channel substrate 21, the drive contact portions 46 of the respective traces 42 are aligned in a row, and the ground contact portion 47 is provided as two ground contact portions 47 which are arranged on both sides of the alignment of the drive contact portions 46. Note that although it is not illustrated in the drawings, each of the ground contact portions 47 is connected to the common electrode 32 via a through hole penetrating through portions of the protective film 40 and the insulating film 41 located immediately below each of the ground contact portions 47.

As depicted in FIGS. 2 and 3, each of the ink supply holes 30*a* of the vibration film 30 is surrounded by an annular-shaped conductive body. On the downstream side in an extension direction of each of the traces 42, conductive bodies (conductive portions 44) are connected to the drive contact portions 46 via the traces 42, respectively. On the other hand, on the upstream side in the extension direction, conductive bodies (conductive portions 44) as a portion of the conductive bodies located on the upstream side are connected to the traces 42, respectively, in a similar manner as those arranged on the downstream side. However, on the upstream side in the extension direction, conductive bodies (conductive portions 45; see FIG. 2) as a remaining portion of the conductive bodies located on the upstream side are independent or isolated, without being connected to the traces 42, respectively. By allowing each of the ink supply holes 30*a* to be surround by the annular-shaped conductive portion 44 or 45, the water-tightness with respect to the ink supply holes 30*a* is enhanced when the cover 23 (to be described later on) is joined to the channel substrate 21.

As depicted in FIG. 4, the trace protecting film 43 is stacked while contacting the plurality of traces 42, and covers the traces 42 from thereabove. The insulating property among the plurality of traces 42 is enhanced owing to the presence of the trace protecting film 43. Note that the trace protecting film 43 does not cover the end portions of the channel substrate 21, and the drive contact portions 46 and the ground contact portions 47 are exposed from the trace protecting film 43. The exposed contact portions 46 and 47 are allowed to be connected to a COF 50 (to be described later on). The trace protecting film 43 is formed, for example, of a silicon nitride (SiNx), etc.

Note that the traces 42 are in contact with each of the insulating film 41 (an example of a "first layer" of the present teaching) which is stacked on the lower side of the traces 42 and the trace protecting film 43 (an example of a "second layer" of the present teaching) which is stacked on the upper side of the traces 42. Here, the trace protecting film 43 on the upper side is formed of a material having a high thermal conductivity than that of the insulating film 41 on the lower side. Specifically, the thermal conductivity of $SiO_2$ forming the insulating film 41 is in a range of 1 W/(m·K) to 1.5 W/(m·K); whereas the thermal conductivity of SiNx forming the trace protecting film 43 is in a range of 20 W/(m·K) to 28 W/(m·K). In this case, as will be described later on, the heat transferred to the traces 42 from the driver IC 51 can be positively released to the cover 23 located above the traces 42.

Each of the individual electrodes 34 is exposed from the protective film 40, etc., except for the peripheral portion of each of the individual electrodes 34. Accordingly, a stacked body of the protective film 40, the insulating film 41 and the trace protecting film 43 hardly inhibits or hinders the deformation of the individual actuators. Further, each of the traces 42 has an extension end portion arranged on the upper surface of the insulating film 41 at a periphery portion in the scanning direction of one of the individual electrodes 34, and the extension end portion of each of the traces 42 is connected to one of the individual electrodes 34 in the thickness direction. The connection between each of the traces 42 and one of the individual electrodes 34 is made via a through hole penetrating through the insulating film 41 and the protective film 40, as depicted in FIG. 4.

As depicted in FIGS. 2 and 3, end portions of a plurality of pieces of the COF 50 are joined to the upper surface of the channel substrate 21, respectively at end portions in the left and right directions of the channel substrate 21. A driver IC 51 (an example of a "driver" of the present teaching) is mounted on an intermediate portion of each of the COFs 50. Further, the other end portions of the respective COFs 50 are connected to the controller 7 (see FIG. 1) of the printer 1.

Each of the COFs 50 is formed with a plurality of traces 52, in addition to traces for the ground contact portions 47 (not depicted in the drawings). Each of the traces 52 is connected to an output terminal of the driver IC 51. At each of the both end portions of the channel substrate 21, the traces 52 are connected to the drive contact portions 46 corresponding thereto respectively and the traces for the ground contact portions 47 is connected to the ground contact portions 47.

Each of the driver ICs 51 generates a drive signal based on a control signal from the controller 7, and outputs the generated drive signal to each of the piezoelectric elements 31. The drive signal is inputted to each of the drive contact portions 46 via one of the traces 52, and further the drive signal is supplied to each of the individual electrodes 34 corresponding thereto via one of the traces 42. In this situation, the potential of the individual electrode 34 is changed between a predetermined driving potential and the ground potential. The potential of the common electrode 32 is always maintained at the ground potential.

The action of each of the piezoelectric elements 31 when the drive signal is supplied from the driver IC to each of the piezoelectric elements 31 will be explained. In a state that the drive signal is not supplied, the potential of the individual electrode 34 is the ground potential that is same as the potential of the common electrode 32. From this state, when the driving potential is applied to the individual electrode 34, an electric field in the thickness direction acts on the active portion 36 of the piezoelectric body 33, due to the potential difference between the individual electrode 34 and the common electrode 32 arranged to face the individual electrode 34. In this situation, the active portion 36 is expanded in the thickness direction and compressed in the planar direction. In combination with the vibration film 30, the active portion 36 (piezoelectric element 31) is bent or curved so as to project toward a pressure chamber 26 corresponding thereto. With this, the volume of the pressure chamber 26 is reduced, which in turn generates a pressure wave inside the pressure chamber 26, thereby causing a nozzle 24 communicating with the pressure chamber 26 to discharge an ink droplet of the ink.

<Cover>

As depicted in FIGS. 2 to 4, the cover 23 is arranged on the upper surface of the channel substrate 21 formed with the piezoelectric actuator 22 such that the cover 23 covers the plurality of piezoelectric elements 31. The cover 23 has not only the function of covering and protecting the plurality of piezoelectric elements 31, but also a function as an ink storing portion configured to temporality store the ink which is to be supplied to the channel substrate 21. The cover 23 is joined to the channel substrate 21 with a thermosetting (heat-hardening) adhesive 66. More specifically, after applying the thermosetting adhesive 66 to either one of the cover 23 and the channel substrate 21, the cover 23 is pressed against the channel substrate 21 while being heated, thereby joining the cover 23 and the channel substrate 21.

As depicted in FIG. 4, reservoirs 60 configured to store the ink are formed in an upper portion of the cover 23. Note that in FIG. 4, only two reservoirs 60 are depicted. However, in actuality, four reservoirs 60 configured to store the four color inks respectively are arrange side by side to one another in the scanning direction. The four reservoirs 60 are sealed by a lid member 65 joined to the upper surface of the cover 23. Further, the four color inks are supplied to the four reservoirs 60, respectively, from the four ink cartridges of the holder 5 (see FIG. 1).

Two wall portions 61*a* and 61*b* extending in the scanning direction and nine wall portions 62*a* to 62*i* extending in the conveyance direction are formed at a lower portion of the cover 23. The nine wall portions 62*a* to 62*i* are arranged side by side to one another in the scanning direction with intervals (spacing distances) therebetween. Note that among the nine wall portions 62*a* to 62*i*, the wall portion 62*a* located on a right end portion of the cover 23 and the wall portion 62*e* located on a left end portion of the cover 23 are each referred to as an "outermost wall portion". Further, among the seven wall portions 62*b*, 62*c*, 62*d*, 62*f*, 62*g*, 62*h* and 62*i* which are located between the two outermost wall portions 62*a* and 62*e*, the wall portion 62*i* located at the center of these seven wall portions is referred to as a "central wall portion", and the wall portions 62*b*, 62*c*, 62*d*, 62*f*, 62*g* and 62*h* which are different from the central wall portion 62*i* are each referred to as an "inner wall portion".

Each of the nine wall portions 62 is joined to the channel substrate 21 while sandwiching, between itself and another wall portion 62 adjacent thereto, one of the piezoelectric element rows 37. Specifically, the outermost wall portion 62*a* on the right side is joined to an area (region) on the right side of four piezoelectric element groups 38 (eight piezoelectric element rows 37), and the outermost wall portion 62*e* on the left side is joined to a region on the left side of four piezoelectric element groups 38. The central wall portion 62*i* is joined to a region between the two central piezoelectric element groups 38*y* and 38*c*. The inner wall portion 62*c* is joined to a region between the two right-side piezoelectric element groups 38*k* and 38*y*; and the inner wall portion 62*g* is joined to a region between the two left-side piezoelectric element groups 38*c* and 38*m*. Each of the remaining inner wall portions 62*b*, 62*d*, 62*f* and 62*h* is joined to a region between two piezoelectric element rows 37 which form or belong to one of the four piezoelectric element groups 38. With this, the lower portion of the cover 23 is partitioned by the wall portions 62, thereby defining eight accommodating spaces 63 which are arranged in the scanning direction. Each of the eight accommodating spaces 63 is configured to accommodate one of the piezoelectric element rows 7.

As described above, on the upper surface of the channel substrate 21, the plurality of ink supply holes 30*a* are opened in a region between the two piezoelectric element rows 37 belonging to (forming) one of the piezoelectric element groups 38. On the other hand, as depicted in FIG. 4, a plurality of channel holes 64 are formed in the cover 23 at the inner wall portions 62*b* (62*d*, 62*f*, 62*h*) each of which is joined to the above-described region between the two piezoelectric element rows 37 belonging to one of the piezoelectric element groups 38. The ink supply holes 30*a* correspond to the channel holes 64, respectively, in a one-on-one manner. The ink stored in each of the reservoirs 60 is supplied to the plurality of pressure chambers 26 aligned in two rows via the plurality of channel holes 64 and the plurality of the ink supply holes 30*a*, respectively.

The widths, of the nine wall portions 62 arranged in the scanning direction is not same among the nine wall portions 62. When comparing the widths of the wall portions 62, the following relationship is provided: (width W1 of each of the two outermost wall portions 62*a*, 62*e*)>(width W2 of each of the inner wall portions 62*b*, 62*d*, 62*f*, 62*h*)>(width W3 of each of the inner wall portions 62*c*, 62*g*)=(width W4 of the central wall portion 62*i*), as depicted in FIGS. 2 and 3. Note that each of the inner wall portions 62*b*, 62*d*, 62*f* and 62*h* has a joining area at which the inner wall portion 62 (62*b*, 62*d*, 62*f*, 62*h*) is joined to the channel substrate 21 and of which actual area (dimension) is small, because each of the inner wall portions 62*b*, 62*d*, 62*f* and 62*h* is formed with the plurality of channel holes 64. Note that, however, even considering the reduced actual joining area in each of inner wall portions 62*b*, 62*d*, 62*f* and 62*h* due to the plurality of channel holes 64, the magnitude (dimensional) relationship among the nine wall portions 62 is not changed, and is same as the magnitude relationship regarding the widths among the nine wall portions 62. Namely, the following relationship is provided: (joining area A1 (with respect to the channel substrate 21) of each of the two outermost wall portions 62*a*, 62*e*)>(joining area A2 of each of the inner wall portions 62*b*, 62*d*, 62*f*, 62*h*)>(joining area A3 of each of the inner wall portions 62*c*, 62*g*)=(joining area A4 of the central wall portion 62*i*).

As described above, from the four right-side piezoelectric element rows 37, a plurality of pieces of the traces 42 are extended rightward. Among these traces 42, traces 42 extended from the leftmost piezoelectric element row 37 pass through a joint region of the inner wall portion 62*d*, a joint region of the inner wall portion 62*c*, a joint region of the inner wall portion 62*b*, and a joint region of the outermost wall portion 62*a* in this order, and are extended up to a region (location) on the outside (on the right side) of the cover 23. With respect to the four joint regions, a larger number of the traces 42 pass through a joint region which is positioned closer to the right side (rightmost side) as the side to which the traces are extended (trace-extension side). Similarly, also from the four left-side piezoelectric element rows 37, a plurality of pieces of the traces 42 are extended leftward. Among these traces 42, traces 42 extended from the rightmost piezoelectric element row 37 pass through a joint region of the inner wall portion 62*h*, a joint region of the inner wall portion 62*g*, a joint region of the inner wall portion 62*f*, and a joint region of the outermost wall portion 62*e* in this order, and are extended up to a region (location) on the outside (on the left side) of the cover 23. Further, with respect to the four joint regions, a larger number of the traces 42 pass through a joint region which is positioned closer to the left side (leftmost side) of the cover 23 than another joint region.

By the way, when the driver IC 51 drives each of the piezoelectric elements 31, the driver IC 51 generates heat. Since a portion of the heat is transferred (conducted) to the channel substrate 21 via the plurality of traces 42, the temperature of the piezoelectric elements 31 and the temperature of the ink in the pressure chambers 26 are raised. In this situation, if the difference in heat transfer amount is great among the pressure chambers 26, or among the piezoelectric elements 31, this causes any difference in the discharge characteristic among the plurality of nozzles 24. Therefore, for the purpose of suppressing any unevenness in the discharge characteristic, it is effective to radiate the heat, which is transferred from the driver IC 51 to the traces 42, to the cover 23 as much as possible. In view of this, the joining area with respect to the channel substrate 21 is different among the plurality of wall portions 62 which are arranged in the direction in which the traces are extended (trace extension direction), for the purpose of realizing a quick heat radiation.

Regarding the joining areas of the four right-side wall portions 62*a* to 62*d*, firstly, the outermost wall portion 62*a* located on the right end portion in the cover 23 has the joining area that is greater than the joining area of each of the three inner wall portions 62*b*, 62*c* and 62*d*. Here, the traces 42 from the two right-side piezoelectric element groups 38*k* and 38*y* pass through the joint region at which the outermost wall portion 62*a* is joined to the channel substrate 21. Namely, since the outermost wall portion 62*a* having a large joining area is joined to the region or location through which a large number of the traces 42 pass in a concentrated manner, the heat transferred to the traces 42 can be effectively released to the cover 23. Further, regarding solely to the three right-side wall portions 62*a*, 62*b* and 62*c*, as the wall portion is located closer to the trace extension side (rightmost side), the wall portion has a greater width W (greater joining area A). Namely, as the number of the traces passing through a joint region is greater, a wall portion having a greater joining area is joined to the joint region, which in turn makes it possible to release the heat transferred to the traces 42 effectively to the cover 23.

Note that from the above-described viewpoint, it is allowable that the width (joining area) of the inner wall portion 62*d* located on the opposite side to the trace extension side is made smaller than that of the inner wall portion 62*c*; and that the widths (joining areas) are made to be smaller in a descending order from the outermost wall portion 62*a*, the inner wall portion 62*b*, the inner wall portion 62*c* and the inner wall portion 62*d*. However, since the inner wall portion 62*d* is a wall portion in which the plurality of channel holes 64 are formed, there is a limit to the width reduction for the inner wall portion 62*d*. Accordingly, the width (joining area) of the inner wall portion 62*d* is made to be same as that of the inner wall portion 62*b* and to be greater than that of the inner wall portion 62*c*.

Regarding the four left-side wall portions 62, similarly regarding the four right-side wall portions 62, the joining area of the outermost wall portion 62*e* located on the left side (leftmost side) is greatest among the four left-side wall portions 62. Further, regarding solely to the three left-side wall portions 62*e*, 62*f* and 62*g*, as the wall portion is located closer to the trace extension side (leftmost side), the wall portion has a greater width W (greater joining area A).

Note that the central wall portion 62*i* is arranged between the two piezoelectric element groups 38*k* and 38*y* (an example of a first piezoelectric element group in the present teaching) from which the traces 42 are extended toward the right side and the two piezoelectric element groups 38*c* and 38*m* (an example of second piezoelectric element group in the present teaching) from which the traces 42 are extended toward the left side. Namely, the traces 42 are not arranged in the joining area, of the central wall portion 62*i*, at which the central wall portion 62*i* is joined to the channel substrate 21. Therefore, from the viewpoint of the releasing the heat transferred to the traces 42, the width of the central wall portion 62*i* is not required to be so large. Thus, the width W4 of the central wall portion 62*i* is made to be same as the width W3 of each of the inner wall portions 62*c* and 62*g*.

The cover 23 has such a configuration including the plurality of inner wall portions 62*b* to 62*h* and the central wall portion 62*i*, in addition to the two outermost wall portions 62*a* and 62*e*. Therefore, when the cover 23 is joined to the channel substrate 21, it is possible to prevent the central portion of the cover 23 from being bent or curbed (sagged). Further, for example, in such a case that the cover 23 is joined to the channel substrate 21 with the adhesive 66 while being heated, the cover 23 is warped and any force in a direction of peeling the cover 23 off from the channel substrate 21 acts on the outermost wall portions 62*a* and 62*e*, in some cases. Even in such a case, the joining area of each of the outer all portions 62*a* and 62*e* is greater than the joining area of each of the inner wall portions 62*b* to 62*h* and the joining area of the central wall portion 62*i*, thereby making it possible to prevent the outermost wall portions 62*a* and 62*e* from being peeled off from the channel substrate 21.

As depicted in FIG. 4, the insulating film 41 on the lower side and the trace protecting film 43 on the upper side are stacked while contacting the traces 42, except for the both end portions of the channel substrate 21 on the left and right sides. Further, the trace protecting film 43 (for example, made of SiNx) is formed of a material a having a thermal conductivity higher than that of the material forming the insulating film 41 (for example, made of $SiO_2$). With this, the heat transferred from the driver IC 51 to the traces 42 can be easily released to the cover 23.

As depicted in FIGS. 2 and 3, projections 67 extending in the conveyance direction are formed respectively in the joint regions in the channel substrate 21 to which the inner wall portions 62*c* and 62*g* are joined (regions in which the ink supply holes 30*a* are not formed). Note that the plurality of traces 42 pass through each of these joint regions, and the projections 67 are formed while avoiding the traces 42. In other words, each of the projections 67 is formed as a plurality of projections 67 which extend in the conveyance direction while being divided by the traces 42. Further, also regarding the scanning direction, a plurality of the projections 67 are arranged in the scanning direction with intervals therebetween.

Owing to the presence of the projections 67, in a case that the inner wall portions 62*c* and 62*g* are joined to the channel substrate 21 with the adhesive 66, the plurality of projections 67 arranged in the scanning direction regulate or restrict the flowing of the adhesive 66 in the scanning direction. The adhesive 66 flows from the inner wall portions 62*c* and 62*g* to the both sides in the scanning direction, respectively, in a substantially same flowing amount, and the amount of the flowing adhesive 66 itself is also small. Accordingly, any excessive adhesive 66 does not hinder the deformation of any piezoelectric element adjacent to the excessive adhesive 66. Further, since the surfaces of the joint regions, in the channel substrate 21, to the inner wall portions 62*c* and 62*g* have a concavo-convex shape (uneven or irregular shape), it is also possible to obtain such an effect that the adhesive strength between the inner wall portions 62*c* and 62*g* and the channel substrate 21 is enhanced.

Note that although the material for forming the projections 67 is not particularly limited, the projections 67 may be formed by using a conductive material same as that for forming the traces 42 (for example, gold, aluminum, etc.), and in a same film forming step as forming the traces 42 (for example, sputtering). Further, in such a case, it is also possible to make the height of the projections 67 and the thickness of the traces 42 to be same. The height of the projections 67 (the thickness of the traces 42) is, for example, not more than 1 μm. With this, the heights of the joining surfaces can be made uniform between the joint regions to the inner wall portions 62*c* and 62*g* and the joint regions to the other wall portions 61 and 62.

As depicted in FIG. 2, a projection 68 extending in the conveyance direction is formed also in the joint region of the channel substrate 21 to which the central wall portion 62*i* is joined. Further, also regarding the scanning direction, a plurality of projections 68 are arranged in the scanning direction with intervals therebetween. Accordingly, it is possible to suppress any flowing of the adhesive 66 between the two piezoelectric element groups 38 arranged on the both sides of the central wall portion 62*i* in the scanning direction. Further, since the surface of the joint region, in the channel substrate 21, to the central wall portion 62*i* has a concavo-convex shape (uneven or irregular shape), it is also possible to obtain such an effect that the adhesive strength between the central wall portion 62*i* and the channel substrate 21 is enhanced. Note that similarly to the above-described projections 67, the projection 68 may also be formed by using a conductive material same as that for forming the traces 42, in a same film forming step for forming the traces 42.

Since the traces 42 are not arranged in the joint region of the channel substrate 21 to which the central wall portion 62*i* is joined, a projection 68 continuously extending in the conveyance direction can be formed in the above-described joint region to which the central wall portion 62*i* is joined, unlike regarding the joint regions for the inner wall portions 62*c* and 62*g*. Specifically, as depicted in FIG. 2, a projection 68*a* which is located at a central area in the joint region is extending continuously in the conveyance direction, and has a length not less than the entire length of the piezoelectric element group 38. With this configuration, the flowing state of any excessive adhesive 66 is made uniform on the both sides sandwiching the central wall portion 62*i*, and an amount of the flowing of excessive adhesive 66 is made to be small. Further, owing to the long projection 68*a*, the adhesive strength between the central wall portion 62*i* and the channel substrate 21 is enhanced, which in turn realizes a central wall portion 62*i* having a narrower width.

Next, an explanation will be given about modifications in which various changes are made to the above-described embodiment. However, any parts or components constructed in the similar manner to that in the above-described embodiment are designated with same reference numerals, and description thereof is omitted as appropriate.

<First Modification>

In the above-described embodiment, the traces 42 are extending in a direction parallel to the scanning direction, at the joint regions of the channel substrate 21 to which the wall portions 62 are joined. It is allowable, however, that the traces 42 are extended in a direction crossing (intersecting) the scanning direction at an angle of less than 90 degrees. For example, in FIG. 5, the traces 42 are extending so as to cross the scanning direction at an angle θ, in the joint region of the channel substrate 21 to which the outermost wall portion 62*a* is joined. In such a manner, in a case that the traces 42 are extending so as to obliquely cross the joint region, the contact length between the traces 42 and the outermost wall portion 62*a* becomes long. With this, the heat transferred from the driver IC 51 to the traces 42 can be easily released to the cover 23. Note that also regarding any joint regions to which the other wall portions 62 are joined, it is allowable that the traces 42 are extending in an oblique manner as described above. Further, in a joint region to which a certain wall portion 62 is joined, it is not required that all of the traces 42 are extending obliquely, and only a trace or traces 42 as a portion of the traces 42 may be extending obliquely.

Figure 5:
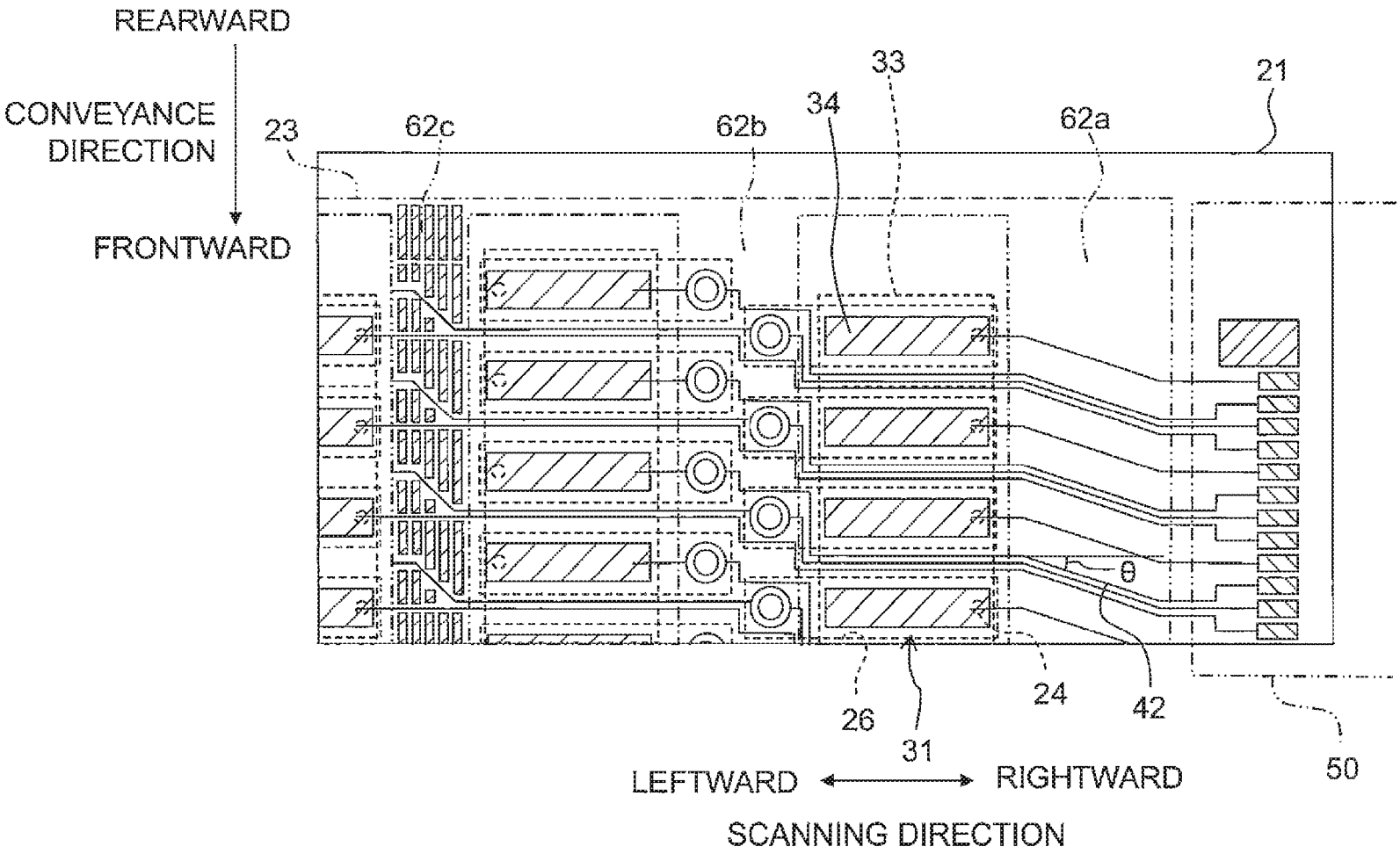
FIG. 5 is a partially enlarged plan view of an ink-jet head according to a modification.

In FIG. 5, the plurality of traces 42 are extending so as to incline toward the central side in the conveyance direction, resulting in shortening the length of the aligned row composed of the contact portions 46 and 47. Namely, FIG. 5 depicts such an aspect wherein the electric and mechanical connectivities can be secured even if the length of the aligned row of the contact portions 46 and 47 in the conveyance direction is short relative to the entire length of the piezoelectric element groups 38. On the other hand, in a case that the securement of the above-described connectivities is a matter of concern, it is allowable that the traces 42 are arranged so as to cross the joint region in such a manner that the traces 42 are inclined in a direction away from the central side in the conveyance direction.

<Second Modification>

In a case that a plurality of inner wall portions are present as in the above-described embodiment, the magnitude relationship (dimensional relationship) in view of the area (size) of the joint region among the inner wall portions can be appropriately changed based on the configuration of the respective wall portions. For example, in FIGS. 2 and 3, the joining areas of the three inner wall portions 62*b*, 62*c* and 62*d* are set such that the joining area of a certain inner wall portion, among the three inner wall portions 62*b*, 62*c* and 62*d*, which is located closer to the trace extension side (right side) is greater than the joining area of the another inner wall portion, among the three inner wall portions 62*b*, 62*c* and 62*d*, which is located farther from the trace extension side than the certain inner wall portion. Namely, it is allowable to provide the following relationship: (joining area of the outermost wall portion 62*a*)>(joining area of the inner wall portion 62*b*)>(joining area of the inner wall portion 62*c*)>(joining area of the inner wall portion 62*d*). Alternatively, the joining area may be made same among all the three inner wall portions 62*b*, 62*c* and 62*d*.

<Third Modification>

The number of the piezoelectric element rows, the number of the wall portions of the cover, or the extension direction of the traces 42, etc., may be changed as follows.

Figure 6:
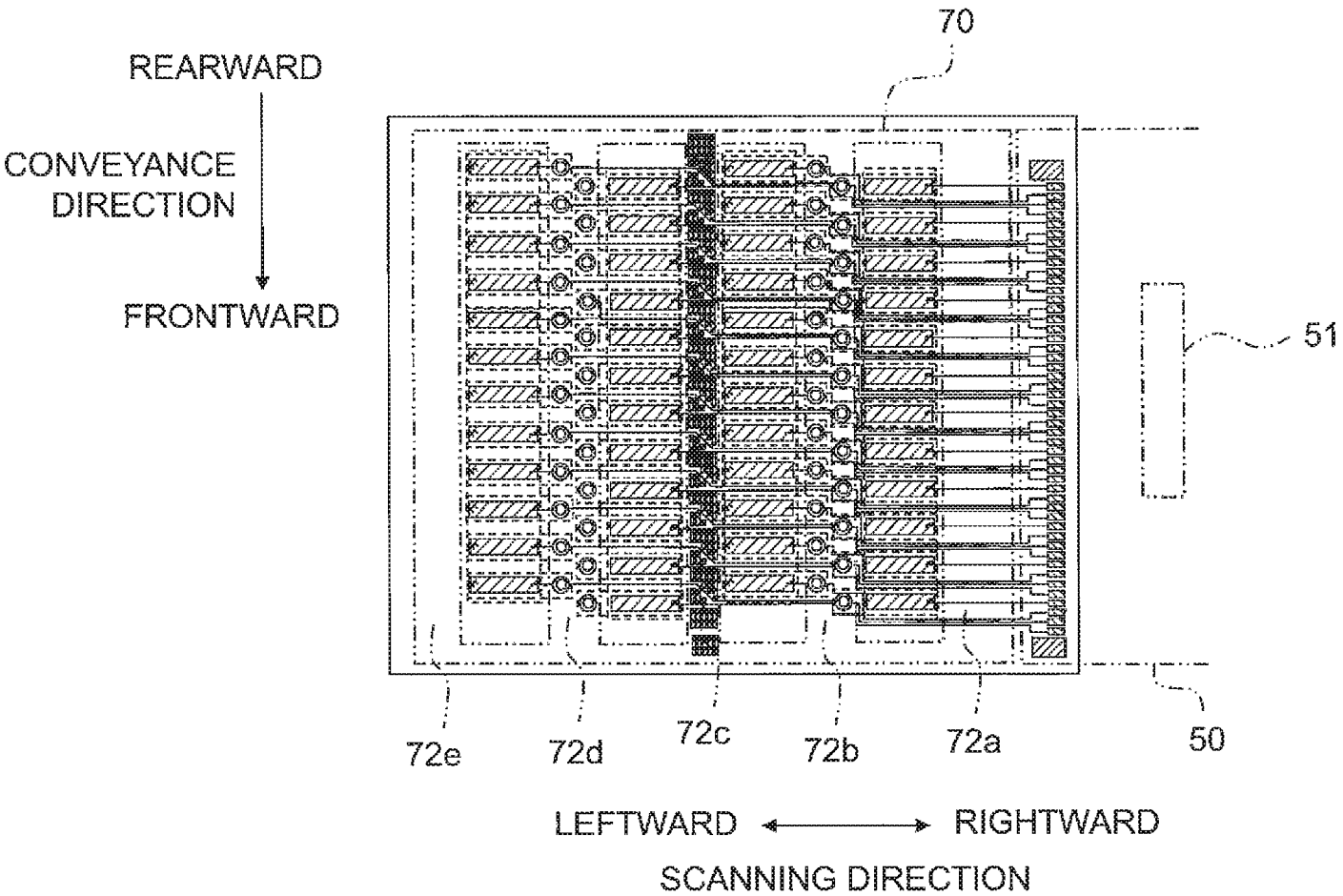
FIG. 6 is a plan view of an ink-jet head according to another modification.

In the above-described embodiment, for example, the plurality of traces 42 are extending on the upper surface of the channel substrate 21 in a manner divided into the left and right sides. In contract, as depicted in FIG. 6, it is allowable to configure that traces 42 of a plurality of piezoelectric elements 31 are all extended in a same direction. In the configuration depicted in FIG. 6, all the traces 42 are extended rightward. Further, the width (joining area) of an outermost wall portion 72*a* on the trace extension side (right side) in a cover 70 is made to be greater than the width (joining area) of each of inner wall portions 72*b*, 72*c*, 72*d* and the width (joining area) of an outermost wall portion 72*e* which are located on the left side with respect to the outermost wall portion 72*a*.

Figure 7:
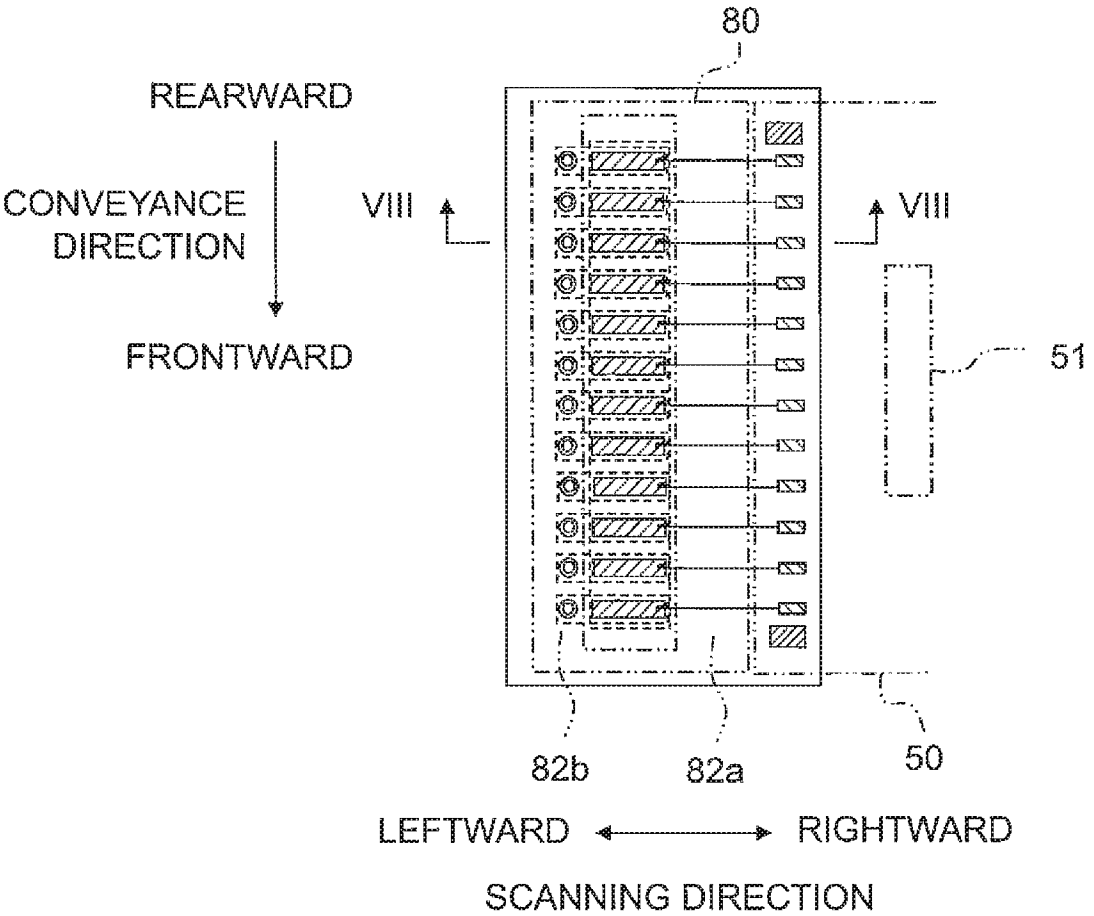
FIG. 7 is a plan view of an ink-jet head according to yet another modification.
Figure 8:
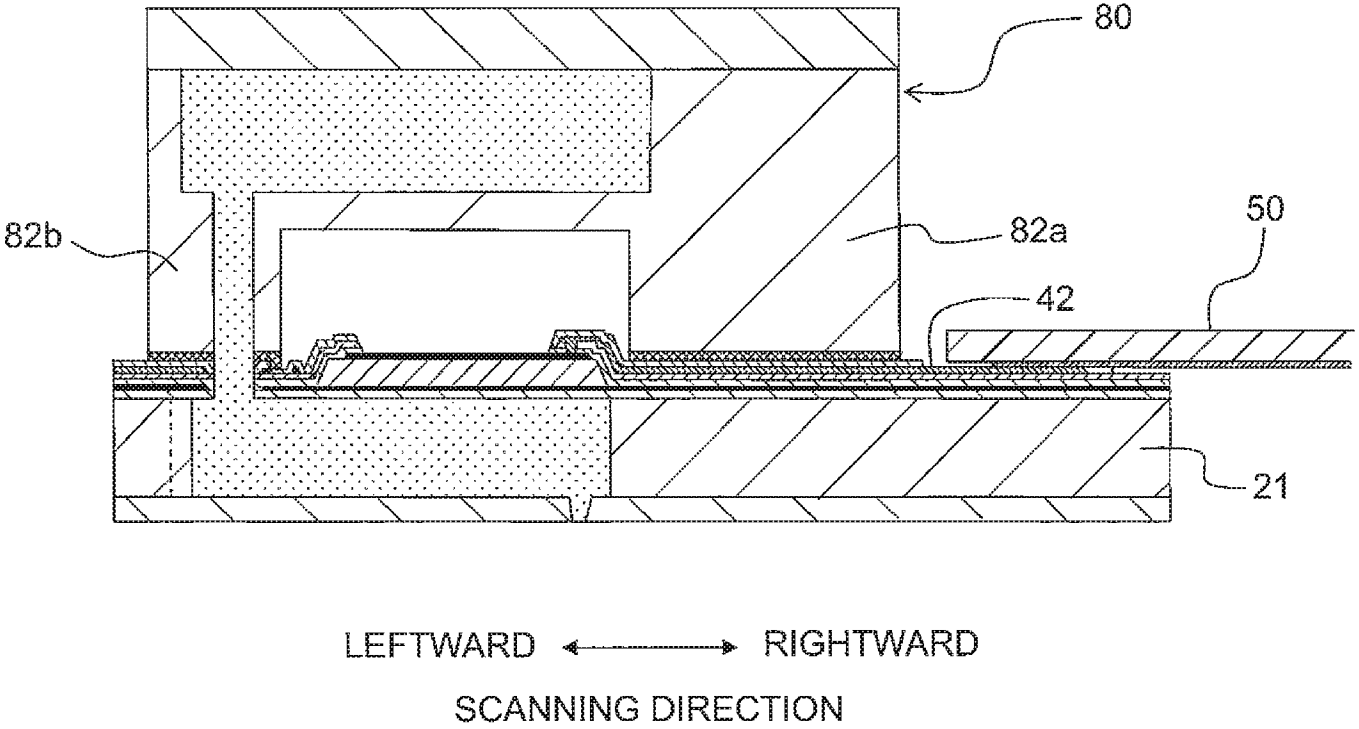
FIG. 8 is a cross-sectional view taken along a line VIII-VIII in FIG. 7.

Alternatively, as depicted in FIGS. 7 and 8, it is allowable to provide such a configuration wherein a cover 80 is not provided with any inner wall portion, and the cover 80 is provided with only two wall portions 82*a* and 82*b* located on the right and left sides, respectively. In the configuration depicted in FIGS. 7 and 8, a plurality of traces 42 are extended rightward from a plurality of piezoelectric elements 31, respectively. In addition to this configuration, the width of the right-side wall portion 82*a* located on the trace extension side is made to be greater than the width of the left-side wall portion 82*b* located on the side opposite to the trace extension side.

<Fourth Modification>

It is sufficient that the cover has at least the function of covering the piezoelectric elements 31; it is not necessarily indispensable that the cover is also provided with the function of temporarily storing the ink. Namely, it is allowable that any reservoir is not formed in the cover. In such a case, since the ink is supplied to the respective pressure chambers 26 from another member which is different from the cover, the channel holes 64 (see FIG. 4) are not formed in the wall portions of the cover.

The embodiment and the modifications thereof as described above are aspects in each of which the present teaching is applied to the ink-jet head, as an example of the liquid discharging apparatus, configured to print an image, etc. on a recording paper by discharging the ink(s) onto the recording paper. However, the present teaching is also applicable to liquid discharging apparatuses usable for various kinds of applications other than the printing of image, etc. For example, the present teaching is applicable also to a liquid discharging apparatus for industrial use which forms a conductive pattern on a surface of a substrate by discharging a conductive liquid onto the substrate.

What is claimed is:

1. A liquid discharging apparatus comprising:

a channel structure having nozzles aligned in a first direction and pressure chambers aligned in the first direction corresponding to the nozzles respectively;

piezoelectric elements aligned in the first direction in the channel structure, corresponding to the pressure chambers respectively;

a cover covering the piezoelectric elements and having a first wall portion and a second wall portion which are arranged in a second direction orthogonal to the first direction, the first wall portion being arranged on one side in the second direction relative to the piezoelectric elements and joined to the channel structure at a first joint region, the second wall portion being joined to the channel structure at a second joint region; and traces configured to be electrically connected to a driver for driving the piezoelectric elements, the traces being extended to the one side in the second direction from the piezoelectric elements respectively, passing through the first joint region, and extending up to outside of the cover, wherein an area of the first joint region is greater than an area of the second joint region.

2. The liquid discharging apparatus according to claim 1, wherein the piezoelectric elements form a first piezoelectric element row and a second piezoelectric element row arranged in the second direction, the first piezoelectric element row being arranged on the one side in the second direction relative to the second piezoelectric element row, the first wall portion is joined to the channel structure at the one side in the second direction relative to the first piezoelectric element row, the second wall portion is joined to the channel structure between the first piezoelectric element row and the second piezoelectric element row.

3. The liquid discharging apparatus according to claim 2, wherein the piezoelectric elements further form a third piezoelectric element row, and the second piezoelectric element row is arranged on the one side in the second direction relative to the third piezoelectric element row.

4. The liquid discharging apparatus according to claim 3, wherein the cover further has a third wall portion joined to the channel structure at a third joint region between the second piezoelectric element row and the third piezoelectric element row, and the area of the second joint region is greater than an area of the third joint region.

5. The liquid discharging apparatus according to claim 3, wherein projections each extending in the first direction are formed in the channel structure at a region at which the second wall portion or the third wall portion is joined to the channel structure.

6. The liquid discharging apparatus according to claim 5, wherein the projections are arranged in the second direction.

7. The liquid discharging apparatus according to claim 6, wherein, in the second direction, the projections are arranged with an interval therebetween.

8. The liquid discharging apparatus according to claim 5, wherein the projections are formed of a conductive material same as a conductive material forming the traces.

9. The liquid discharging apparatus according to claim 8, wherein each of the projections has a thickness same as a thickness of each of the traces.

10. The liquid discharging apparatus according to claim 1, wherein a width in the second direction of the first wall portion is greater than a width in the second direction of the second wall portion.

11. The liquid discharging apparatus according to claim 1, wherein the piezoelectric elements form a first piezoelectric element group and a second piezoelectric element group arranged on the other side in the second direction relative to the first piezoelectric element group, some of the traces extend toward the one side in the second direction from the first piezoelectric element group, and the other of the traces extend toward the other side in the second direction from the second piezoelectric element group, the cover has two outer wall portions, one of the two outer wall portions being the first wall portion and joined to the channel structure on the one side in the second direction relative to the first piezoelectric element group, the other of the two outer wall portions being joined to the channel structure on the other side in the second direction relative to the second piezoelectric element group, the second wall portion is joined to the channel structure between the first and second piezoelectric element groups, and an area of each of outer joint regions, at which the two outer wall portions are joined to the channel structure, is greater than the area of the second joint region.

12. The liquid discharging apparatus according to claim 11, wherein projections each extending in the first direction are formed in the channel structure at the second joint region.

13. The liquid discharging apparatus according to claim 12, wherein the projections are arranged in the second direction at the second joint region.

14. The liquid discharging apparatus according to claim 13, wherein the projections are arranged in the second direction with an interval therebetween.

15. The liquid discharging apparatus according to claim 13, wherein among the projections, a central projection, which is located at a central portion of the second joint region in the second direction, has a length not less than an entire length of each of the first and second piezoelectric element groups in the first direction.

16. The liquid discharging apparatus according to claim 12, wherein the projections are formed of a conductive material same as a conductive material forming the traces.

17. The liquid discharging apparatus according to claim 16, wherein each of the projections has a thickness same as a thickness of each of the traces.

18. The liquid discharging apparatus according to claim 1, wherein a first layer is formed on a side of the channel structure relative to the traces, while contacting the traces, a second layer is formed on a side of the cover relative to the traces, while contacting the traces, and the second layer is formed of a material having a heat conductivity higher than a heat conductivity of a material forming the first layer.

19. The liquid discharging apparatus according to claim 1, wherein at least a portion of each of the traces crosses the first joint region in a direction intersecting the first direction and the second direction.

20. The liquid discharging apparatus according to claim 1, further comprising the driver.

* * * * *